US005601886A

United States Patent [19]

Ishikawa et al.

[11] Patent Number: 5,601,886

[45] Date of Patent: Feb. 11, 1997

[54] ARTIFICIAL TURF

[75] Inventors: Yoshio Ishikawa, Kishiwada; Hiroaki Fukumoto, Kitakatsuragi-gun, both of Japan

[73] Assignee: Otsuka Kagaku Kabushiki Kaisha, Osaka, Japan

[21] Appl. No.: 446,770

[22] PCT Filed: Dec. 20, 1993

[86] PCT No.: PCT/JP93/01843

§ 371 Date: Jun. 5, 1995

§ 102(e) Date: Jun. 5, 1995

[87] PCT Pub. No.: WO95/09949

PCT Pub. Date: Apr. 13, 1995

[30] Foreign Application Priority Data

Jul. 10, 1993 [JP] Japan ..... 5-251743

[51] Int. Cl.[6] ..... A41G 1/00

[52] U.S. Cl. ..... 428/17; 428/85; 428/95; 273/DIG. 13

[58] Field of Search ..... 428/15, 17, 85, 428/95; 273/DIG. 13

[56] References Cited

U.S. PATENT DOCUMENTS

| | | | |
|---|---|---|---|
| 3,565,742 | 2/1971 | Stephens et al. | 428/17 X |
| 3,940,522 | 2/1976 | Wessells | 428/17 |
| 4,389,435 | 6/1983 | Haas, Jr. | 428/17 |
| 4,444,815 | 4/1984 | Friedrich | 428/17 |
| 5,462,778 | 10/1995 | Ishikawa | 428/17 |

*Primary Examiner*—Henry F. Epstein
*Attorney, Agent, or Firm*—Larson and Taylor

[57] ABSTRACT

An artificial turf of the invention is disclosed in which tufts of artificial grass filaments are implanted on a backing structure to form a pile surface, and tufts of assist filaments, which are shorter than the artificial grass filaments, are implanted between the tufts of the artificial grass filaments. This construction prevents the artificial grass filaments from folding for a long period of time since the assist filaments support the artificial grass filaments, so that a soft and resilient feel resembling natural turf can be obtained. When using longer lengths of artificial grass filaments, it is possible to obtain an appearance similar to natural turf and to enhance sliding characteristics on a turf surface, whereby sliding actions in a soccer game or the like can be performed readily. Furthermore, in the case of providing a sand layer over the backing cloth with the tips of the artificial grass filaments projected from the surface of the sand layer, the obtained artificial turf maintains a softness suitable for use in courts, playgrounds or the like for a long period of time.

2 Claims, 5 Drawing Sheets

ARTIFICIAL TURF

TECHNICAL FIELD

The invention relates to an artificial turf.

BACKGROUND ART

Recently, artificial turfs are often used to cover courts or playgrounds on which sports activities such as tennis, baseball, football, rugby and the like are played. These turfs have a tendency to have their filaments folded by compressive load applied by players' walking, running, jumping or the like. To prevent this problem, short lengths of filaments of about 10 to 15 mm have been tufted at a high density. Alternatively, long lengths of filaments have been used with their lower parts buried in an amount of sand which forms a support layer. However, the former product differs in appearance from natural turf, and the sand layer of the latter has a tendency to solidify by being repeatedly stepped on during long continued use, resulting in loss of softness suitable for use on courts and playgrounds.

DISCLOSURE OF THE INVENTION

It is, therefore, an object of the invention to provide an artificial turf which overcomes the problems associated with the prior art and comprises filaments difficult to fold. It is another object of the invention to provide an artificial turf provided with a sand layer which can maintain desirable softness for a long period of time.

The above objects of the invention can be accomplished by an artificial turf comprising tufts of artificial grass filaments implanted on a backing structure to form a pile surface and tufts of assist filaments of shorter length implanted between the tufts of artificial grass filaments.

The term "filament" as used herein includes yarns called as tape-yarn supplied as a continuous ribbon, slit yarn, split yarn, film yarn and the like.

BEST MODES OF CARRYING OUT THE INVENTION

Now, embodiments of the present invention will be described with reference to the accompanying drawings.

Figure 1:
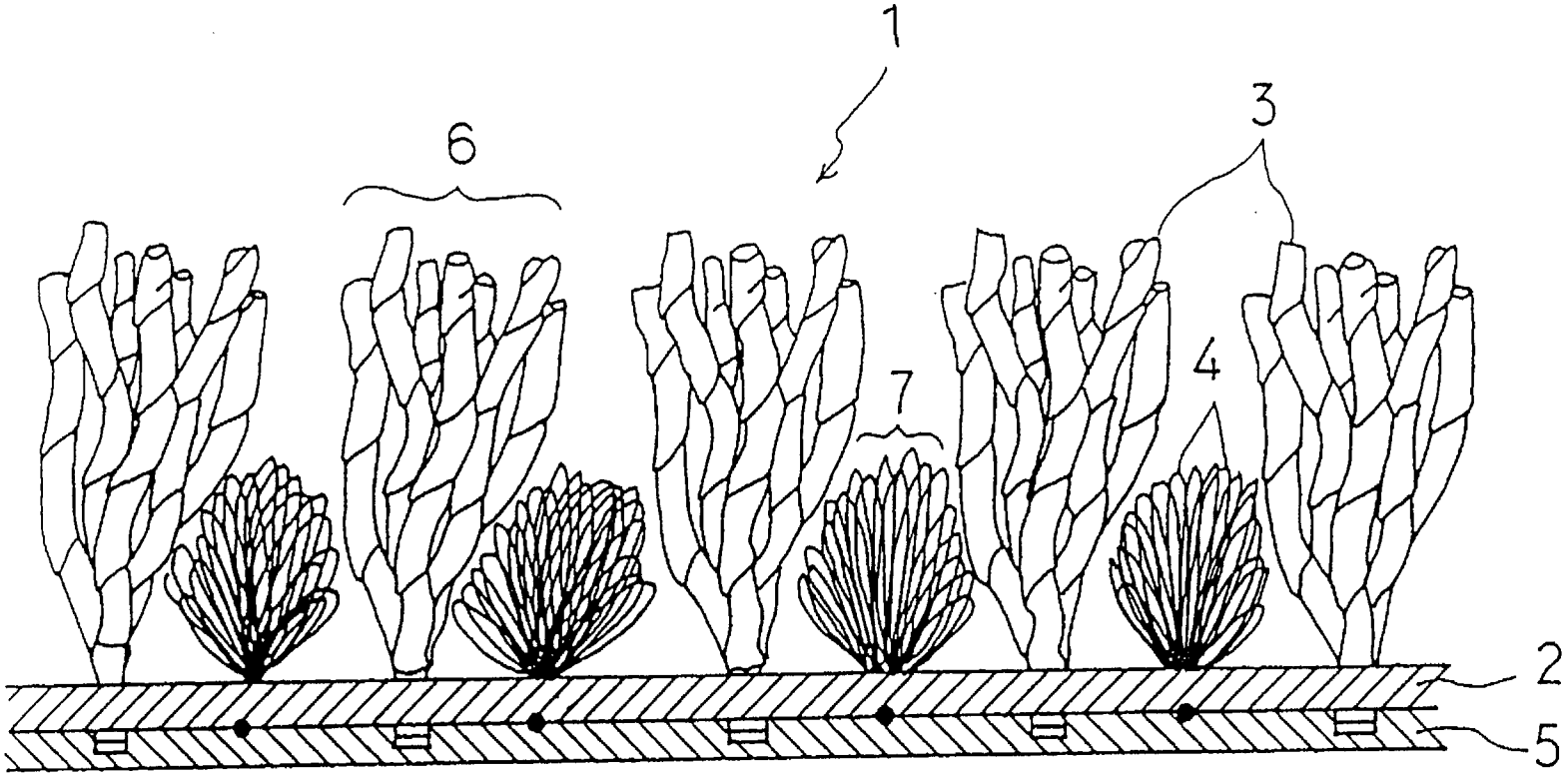
FIG. 1 is a side elevation in vertical section illustrating an artificial turf as one embodiment of the invention.

An artificial turf 1 shown in FIG. 1 is constructed such that longer lengths of artificial grass filaments 3 and shorter lengths of assist filaments 4 are respectively implanted on a backing material, i.e., a backing cloth 2 so as to form respective tufts. A plurality of the synthetic resin artificial grass filaments 3 and assist filaments 4 are respectively bundled and then tufted to form alternate rows of the tufts of the respective filaments. On the underside of the backing cloth is provided a backing resin layer 5 for preventing the filaments from slipping off.

Figure 2:
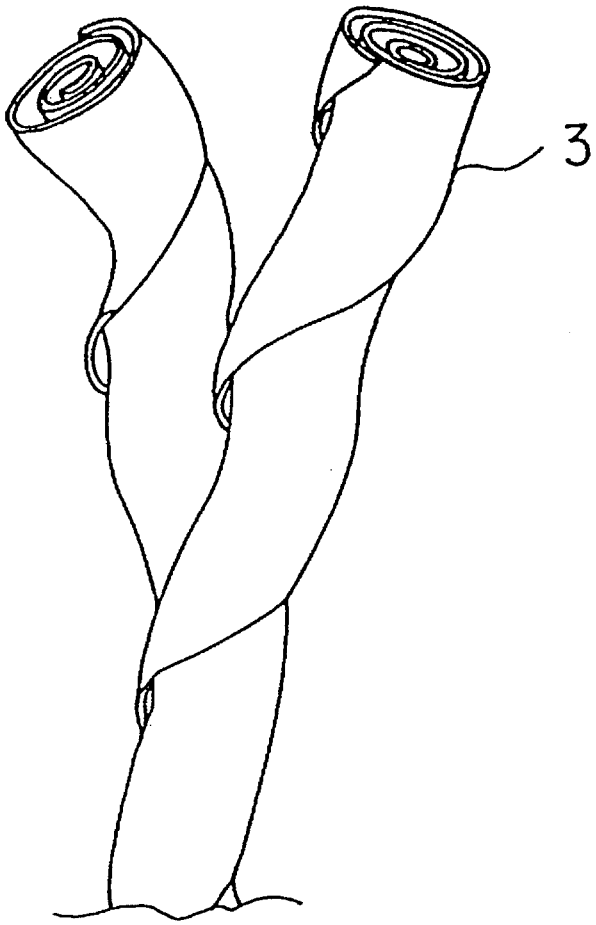
FIG. 2 is an enlarged view of artificial grass filaments used for the artificial turf of FIG. 1.

To closely resemble the appearance of natural turf, the artificial grass tuft 6 is usually cut. However, it may be of a loop type depending on applications. It should be noted that a cut pile construction has advantages of enhancing sliding characteristics of a turf and therefore reducing the generation of frictional heat. In the case of using specially long lengths of artificial grass filaments 3 to eliminate unnatural directionality in a pile surface caused by tufting, these filaments are preferably subjected to a crimping process. The assist filaments 4 are preferably loop-shaped to increase their supporting force, but the loops of the filaments may be cut depending on applications. Furthermore, the assist filaments 4 are preferably subjected to a crimping process in order to prevent compressive load from concentrating on the base portions of the filaments and to therefore maintain their resiliency for a long period of time. This embodiment uses the artificial grass filaments 3 constituted by crimping a wide tape-shaped film and then plying it to have a spiral cross section as seen in FIG. 2. Inside the spiral cross section, there is a void space formed which can hold water which penetrates into the space by surface tension, whereby water retentivity is improved. As the method of crimping filaments, the knitting and deknitting method or other various methods can be used.

The thickness and denier number of the artificial grass filament used may be appropriately selected within the range that conventional artificial turfs adopt. However, when the artificial grass filament 3 is too thin, it lacks durability, and when too thick, it differs from natural grass in appearance and feel. Therefore, the artificial grass filament is preferably in the range of 300 to 1,500 denier. When the assist filament 4 is too thin, it can not sufficiently support the tufts of artificial grass filaments, and when too thick, it imparts a hard feel to the resultant artificial turf. Therefore, the assist filament 4 is preferably in the range of 30 to 300 denier. From the same viewpoint, a bundle of artificial grass filaments of the respective tufts 6 preferably have a denier of 3,000 to 12,000, and a bundle of assist filaments of the respective tufts 7 preferably have a denier of 1,500 to 12,000.

The length of the artificial grass filament may be selected to be an appropriate value, e.g., 15 mm, 20 mm 25 mm, 30 mm or the like, depending on applications. In accordance with the selected length, the height of the assist filament may be correspondingly selected. However, the tips of the assist filaments are formed lower than those of the artificial grass filaments whichever height they may have. The height of the assist filaments is so determined that they may be beneath the artificial grass filaments so as not to be seen directly and can support the artificial grass filaments. More specifically, the height of the assist filaments is preferably 20 to 80% of that of the artificial grass filaments, more preferably 25 to 45%. The height ratio of the assist filament relative to the artificial grass filament is calculated based on the height of filaments measured by vertically aligning the top ends of the filaments with the bottom ends. In the case of crimped filaments, this ratio is calculated under the same condition, but with crimps in the filaments retained.

The artificial turf of the present embodiment is fabricated as follows. In a tufting machine, there is provided a needle row consisting of two types of tufting needles, one of which is used for tufting artificial grass filaments and the other is for assist filaments. The descending amount of the needles for assist filaments to penetrate into the backing cloth is set to be less than that of the needles for artificial grass filaments. A cut knife synchronous with a looper may work on the rows implanted by one or both of the needles when necessary. In the illustrated example, the looper works on only the tufts of artificial grass filaments so as to form rows of loop tufts of shorter length (assist tufts) and rows of cut tufts of longer length (artificial grass tufts).

Further, artificial grass tufts of longer length and crimped assist tufts of shorter length can be formed utilizing the heat applied in the backing process. In one method, non-heat shrinkable fibers are used as the artificial grass filaments, and heat shrinkable fibers are used as the assist filaments. Both of the filaments are tufted at the same level. When the backing process is conducted only the assist filaments are heat-shrunk, whereby the artificial grass tufts of longer length and the crimped assist tufts of shorter length are formed. The heat shrinkable fibers may be general synthetic fibers such as nylon and polyethylene. The non-heat shrinkable fibers can be obtained by an elongation process of a higher temperature than the backing process and therefore are not heat-shrunk during the backing process.

In a second method, both of the artificial grass filaments and assist filaments are heat-shrinkable fibers, wherein the heat shrinkage of the former is small, and the same of the latter is large. During the backing process, the assist filaments shrink much more than the artificial grass filaments so that the artificial grass tufts of longer length and the assist tufts of shorter length are formed. The heat-shrinkage of the respective filaments can be controlled by adjusting the stretching amount before a spinning process. When the stretched amount is set to be large, the heat-shrinkage of the filaments becomes large, and when the stretching amount is set to be small, the heat-shrinkage becomes small.

In a third method, both of the artificial grass filaments and the assist filaments are heat-shrinkable fibers. The former is thick and the latter is thin. During the backing process, the assist filaments shrink much more than the artificial grass filaments so that the grass-like tufts of longer length and the crimped assist filaments of shorter length are formed.

In the artificial turf of the invention, the tufts of artificial grass filaments are implanted on the backing structure so as to form a pile surface, and the tufts of assist filaments of shorter length are implanted between the tufts of artificial grass filaments. Therefore, the artificial grass filaments are supported by the assist filaments and are prevented from folding for a long period of time. Accordingly, there is no need for providing a sand layer in the artificial grass filaments to support them. Furthermore, it is possible to use long lengths of filaments to thereby obtain the appearance closely resembling natural turf. The use of long lengths of filaments improves, sliding characteristics on the turf surface, whereby sliding actions in a soccer game or the like can be performed without difficulty. The friction on the long lengths of filaments is small so that skin burns or frictional injuries can be prevented. Further, due to the resilient support by the assist filaments, the surface of the artificial turf is provided with resiliency so that the turf of the invention can rapidly respond to applied load and the release thereof compared with the case where an underlay is placed under an artificial turf to provide resiliency, whereby quick movements as in sports activities or the like can be made without difficulty. When using assist filaments thinner than grass-like filaments, water retentivity in a turf can be improved.

Figure 3:
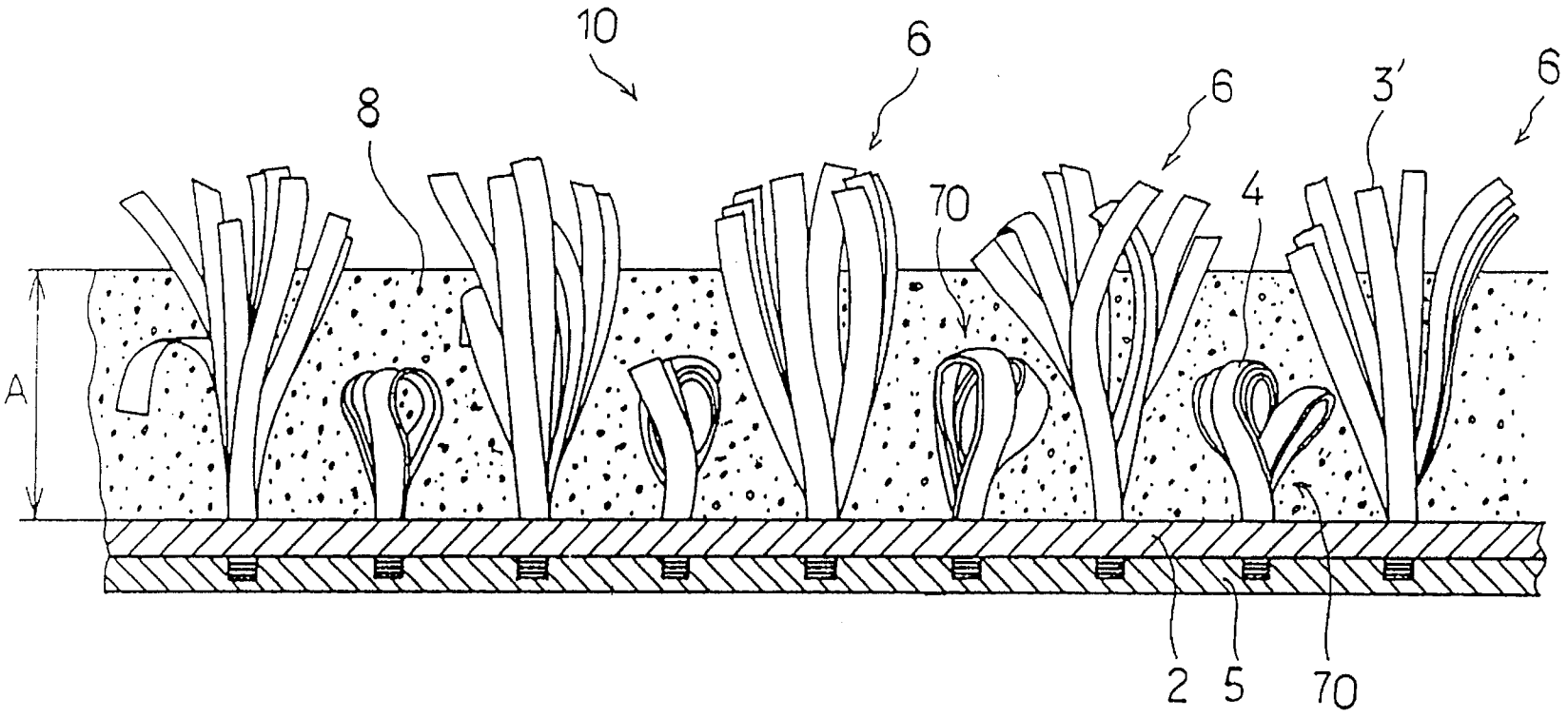
FIGS. 3 to 5 are side elevations in vertical section illustrating examples in which a sand layer is provided respectively in different artificial turfs embodying the invention.
Figure 4:
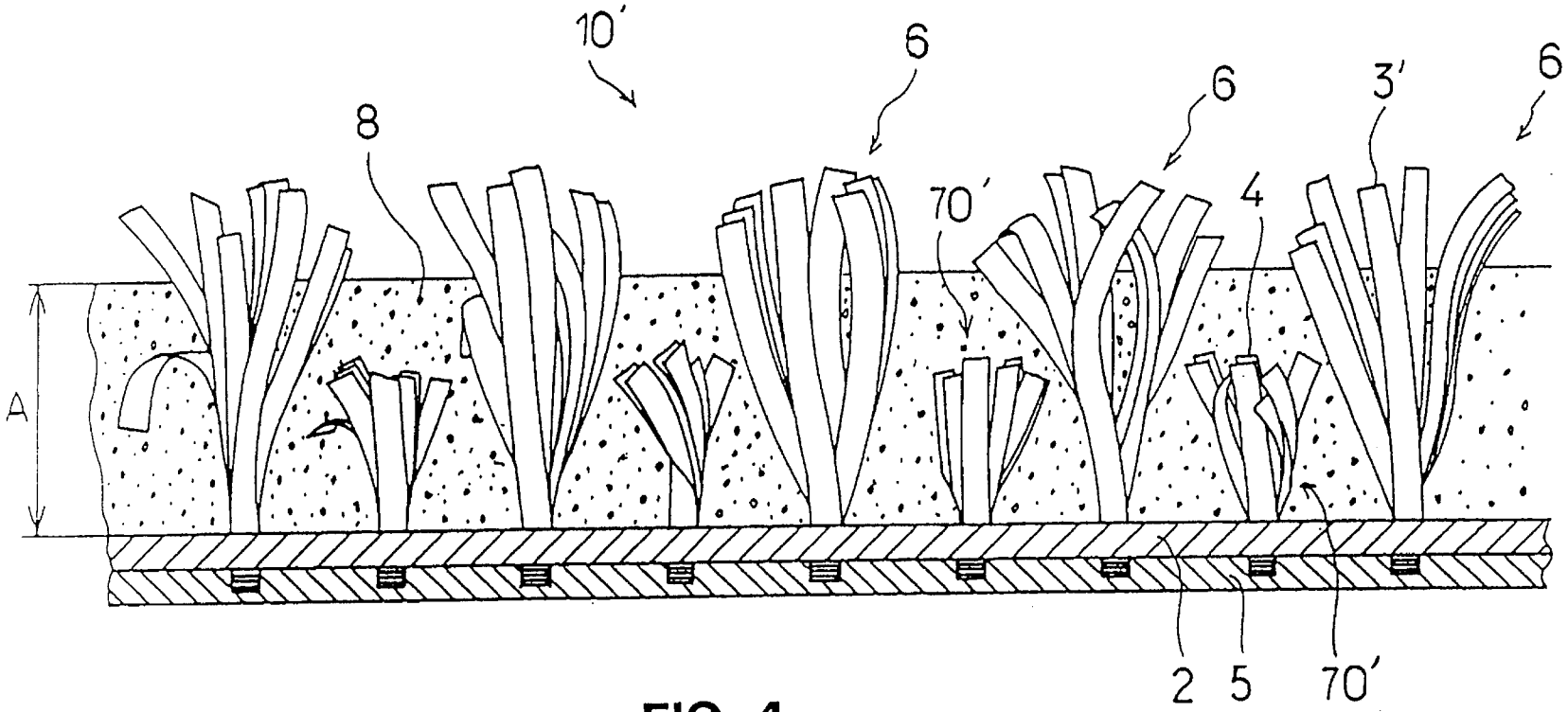
Figure 5:
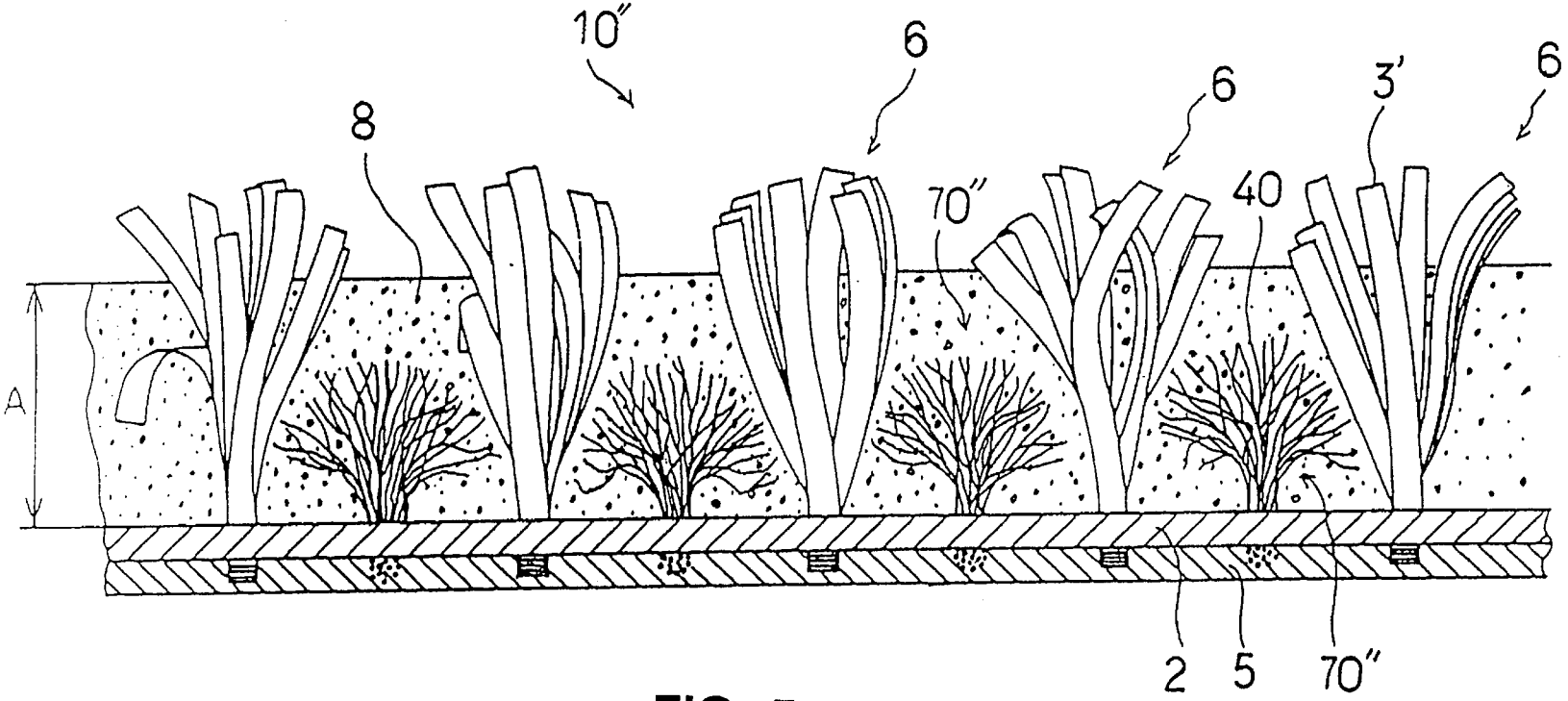

FIGS. 3 to 5 illustrate embodiments in which a sand layer is provided in the artificial turf of the invention.

In the cross section shown in FIG. 3, the artificial turf 10 comprises a plurality of synthetic resin artificial grass filaments 3' bundled together and implanted on the backing cloth 2 of a backing structure by tufting to form a number of rows of artificial grass tufts 6 (the drawing shows a lateral cross section of a row formed by tufting). A plurality of assist tufts, consisting of a plurality of bundled synthetic resin assist filaments 4, are implanted along the rows of artificial grass tufts 6 of the artificial turf 10, thereby forming their own rows 70. In this embodiment, the assist tufts 70 are of a loop type in which case the loop shape imparts resiliency to the assist tufts 70.

FIG. 4 is a cross section illustrating still another embodiment, i.e., an artificial turf 10'. This artificial turf comprises a plurality of synthetic resin artificial grass filaments 3' bundled together and implanted on the surface of the backing cloth 2 as in the case of FIG. 3 to form a number of rows of grass-like tufts 6 and further a plurality of synthetic resin assist filaments 4 bundled together and implanted along the rows of the artificial grass tufts 6 to thereby form rows of assist tufts 70'. In this embodiment, the assist tuft 70' is of a cut pile type in which case the assist filaments 4' constituting the cut pile are preferably plied or crimped by a crimping process.

The artificial turfs 10 or 10' are placed and appropriately fixed on a ground surface such as a playground or a court. For using the turf as a sand-filled artificial turf, sand is filled to a level (i.e., to the level indicated by an arrow A in the drawing) on the backing cloth 2 so as to form a sand layer 8 with the top ends of the artificial grass tufts projected from the surface of the sand. The assist tufts 70 or 70' are formed lower than the artificial grass tufts 6 as described above so that the assist tufts are buried in the sand layer 8 formed on the backing cloth as shown in FIGS. 3 and 4.

As the material for the artificial grass tuft, it is possible to use such synthetic resins as polypropyrene, polyethylene, nylon, polyester and vinylidene chloride, which have been used for conventional artificial turfs and have excellent weather-resistant properties and durability. As the material for the assist tuft, natural fibers can be used besides the above-mentioned synthetic resins. The natural fibers are preferably those having stiffness and excellent resiliency such as hemp and jute.

As monofilaments constituting the artificial grass tufts and the assist tufts, i.e., the artificial grass and assist filaments, it is possible to use usual flat filaments, filaments having a circular cross section or film yarn having nick portions to be divided into a grass-like shape. As these filaments, especially as the assist filaments, it is also possible to use filaments having an excellent water absorbing capability, such as hollow filaments or natural fibers.

Still further, another embodiment shown in FIG. 5, i.e., an artificial turf 10" comprises assist tufts 70" constituted by bundling and cutting thin filaments 40 of natural fibers or synthetic fibers, those tufts extending and spreading upward from the backing cloth 2. In the case of using thin synthetic filaments as the assist tufts 70", the filaments may be subjected to a crimping process beforehand so as to impart resiliency to the filaments. Analogously to the previous embodiment (FIGS. 3 and 4), the artificial turf comprises the assist turfs 70" with their tips formed lower than the artificial grass tufts 6, wherein each row of the assist tufts 70" is formed lower than and between the rows of the artificial grass tufts 6. As in the previous embodiment, this artificial turf 10" is filled with sand up to the level indicated by an arrow A in the drawing in such a manner that only the tip portions of the artificial grass tufts 6 project from the sand layer 8. Accordingly, the assist tufts 70" are buried in the sand layer.

In the artificial turf with the sand layer thus formed, compressive load applied by a foot is transmitted to the assist tufts 70, 70' and 70" buried in the sand layer 8, as well as to the sand layer 8. At this time, the density of sand particles in the sand layer 8 is increased by the applied compressive load, and the assist tufts 70, 70' and 70" deform and absorb the compressive load transmitted from surrounding sand particles. After the compressive load is released, the assist tufts restore their original forms and push back the sand layer 8 because of their resiliency. In order for the assist tufts to easily push back the sand layer, the heights (A) of the sand layer respectively indicated in the drawings are determined so that the resiliency of the assist tufts 70, 70' and 70" can be fully utilized, and that not so much weight of sand is applied on the assist tufts. That is, the sand layer is formed about 3 to 10 mm higher than the tips of the assist tufts, more preferably about 5 mm higher.

In the artificial turf of this embodiment, the rows of assist tufts are formed between the rows of artificial grass tufts on the backing structure with the tips of the assist tufts lower than those of the artificial grass tufts, and the assist tufts are buried in the sand layer formed on the backing cloth with the tip portions of the artificial grass filaments projecting from the surface of the sand layer. Therefore, the sand layer in the artificial turf is prevented from solidifying because of the resiliency of the assist tufts so as to maintain desirable softness for long use on courts, playgrounds or the like. Further, the artificial turf is advantageous in that it prevents the reduction of permeability which is caused by the solidification of the sand layer.

Depending on applications, a plurality of rows of assist tufts may be implanted between the adjacent rows of the artificial grass tufts implanted on the backing structure. Alternatively, each row of assist tufts may be formed for a plurality of rows of artificial grass tufts so as to adjust the softness of the artificial turf. In this case, the production of the artificial turf is conducted by a tufting machine which comprises needles, loopers and knives suitable for tufting the artificial grass tufts and assist tufts.

We claim:

1. An artificial turf wherein tufts of artificial grass are implanted in rows on a backing structure to form a pile surface, and tufts of assist filaments shorter than the artificial grass are implanted to form rows between the rows of tufts of artificial grass, and wherein a sand layer is also provided on the backing structure such that at least a portion of the artificial grass projects from the surface of the sand layer and the tufts of assist filaments are buried in the sand layer.

2. An artificial turf according to claim 1 wherein the assist filaments are loop-shaped.

* * * * *

UNITED STATES PATENT AND TRADEMARK OFFICE

CERTIFICATE OF CORRECTION

PATENT NO. : 5,601,886

DATED : February 11, 1997

INVENTOR(S) : ISHIKAWA et al.

It is certified that error appears in the above-indentified patent and that said Letters Patent is hereby corrected as shown below:

On the title page, item [30] should read as follows:

[30] Foreign Application Priority Data

Oct. 7, 1993 [JP] Japan ..... 5-251743

Signed and Sealed this

Thirteenth Day of May, 1997

Bruce Lehman

*Attest:*

BRUCE LEHMAN

*Attesting Officer*

*Commissioner of Patents and Trademarks*